United States Patent [19]

Kuramoto et al.

[11] Patent Number: 4,812,787

[45] Date of Patent: Mar. 14, 1989

[54] LUMPED CONSTANT NON-RECIPROCAL CIRCUIT ELEMENT

[75] Inventors: Kenji Kuramoto; Manabu Yumoto, both of Tottori, Japan

[73] Assignee: Nippon Ferrite, Ltd., Japan

[21] Appl. No.: 110,342

[22] Filed: Oct. 20, 1987

[30] Foreign Application Priority Data

Oct. 23, 1986 [JP] Japan ..... 61-253401

[51] Int. Cl.[4] ..... H01P 1/387

[52] U.S. Cl. ..... 333/1.1; 333/24.2

[58] Field of Search ..... 333/1.1, 24.2

[56] References Cited

U.S. PATENT DOCUMENTS 3,456,213 7/1969 Hershenov ..... 333/1.1

*Primary Examiner*—Paul Gensler

*Attorney, Agent, or Firm*—Finnegan, Henderson, Farabow, Garrett & Dunner

[57] ABSTRACT

A lumped constant non-reciprocal circuit element such as a circulator or an isolator comprising a set of mutually insulated central conductors, a garnet plate not more than 0.6 mm in thickness, a ceramic substrate having a central bore for accommodating the garnet plate and patterned electrodes formed thereon, and a permanent magnet for applying a DC magnetic field to the garnet plate. Because of this structure, this circuit element is very thin with good insertion loss properties.

3 Claims, 4 Drawing Sheets

LUMPED CONSTANT NON-RECIPROCAL CIRCUIT ELEMENT

BACKGROUND OF THE INVENTION

The present invention relates to lumped constant non-reciprocal circuit elements such as circulators and isolators for use in VHF, UHF and microwave frequency bands.

A circulator can be converted into an isolator if one port is closed with a dummy resistor, and an isolator can be converted into a circulator if one port is used as a connection port for external networks. Namely, they are of the same structure, though they are called differently depending on how they are used. Thus, lumped constant circulators and isolators have the same technological basis. Hence, it should be noted that though isolators are explained hereinafter, substantially the same explanations are applicable to circulators.

A typical prior art isolator is shown in a cross sectional view in FIG. 7. The isolator has three sets of central conductors 201 positioned between two garnet plates 202 which are insulated from the conductors by means of an insulator, and these elements are covered with a shielding plate 203. They are placed in the central bore of a ceramic substrate 204 with one end of each conductor 201 connected to a corresponding electrode (not shown) provided on the ceramic substrate 204. A permanent magnet 206 coated with an iron plate 205 is provided above the garnet plate 202. All of these elements are housed by the casing 207 and 208. Other elements such as hollow coils and capacitors may be implemented therein if required. Two ceramic substrates are often laminated.

Such prior art isolators have been made compact followig the miniaturizaiton of other microwave elements. For example, a very small isolator having an area of 20 mm×20 mm and a height of 10 mm has been realized, which uses garnet plates of 10 mm in outer diameter and 0.9 mm in thickness, and a permanent magnet of 13 mm in outer diameter and 4 mm in thickness.

Although prior art isolators have been made very compact, they are still much larger than other microwave elements. In particular, they are too high, protruding above surrounding elements. Thus, it has been desired to provide isolators with a much thinner construction.

OBJECT AND SUMMARY OF THE INVENTION

Therefore, it is an object of the present invention to provide such thinner non-reciprocal circuit elements.

The inventors of this application have tried to make a conventional two-garnet plate circulator or isolator more compact simply by removing one of the garnet plates. However, it has been found that the removal of one garnet plate alone does not yield a satisfactory single garnet circulator or isolator. The present invention has been achieved by finding optimum parameters for a single-garnet plate circulator or isolator having satisfactory characteristics through varying the thicknesses of the garnet plate and the conductors, and the shape of the patterned electrodes on the ceramic substrate.

The isolator or circulator according to the present invention comprises a set of mutually insulated central conductors, one garnet plate of 0.6 mm or less in thickness, a ceramic substrate having patterned electrodes thereon and a central bore for accommodating the above garnet plate therein, and a permanent magnet for applying a DC magnetic field to the above garnet plate.

DETAILED DESCRIPTION OF THE PREFERRED EMBODIMENTS

Figure 1:
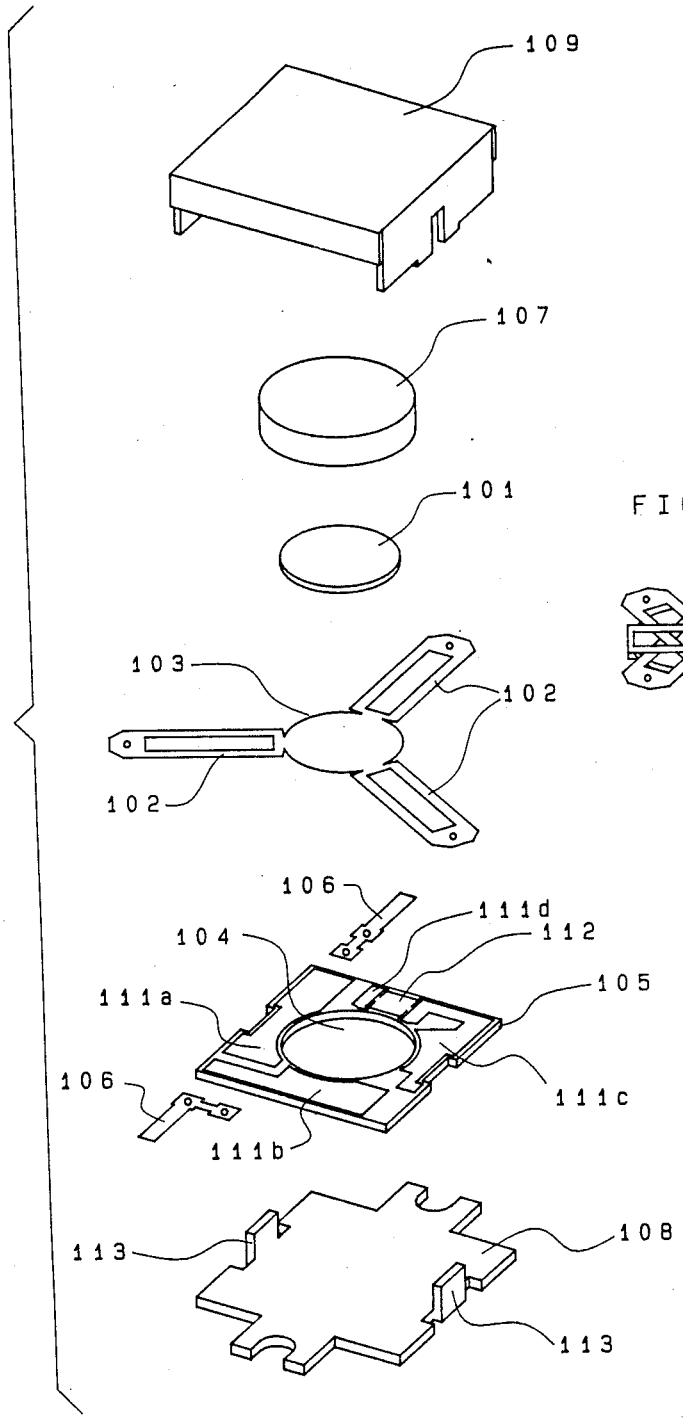
FIG. 1 is an exploded perspective view of an isolator according to one embodiment of the present invention.
Figure 2:
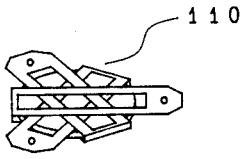
FIG. 2 is a perspective view of central conductors for the isolator of FIG. 1.

An isolator according to one embodiment of the present invention is shown in FIG. 1. In this embodiment, the isolator comprises a garnet plate 101 which typically has a diameter of 10 mm and a thickness of 0.5 mm, an integrally punched-out metal sheet having three central conductors 102, and a shield plate portion 103, a ceramic substrate 105 having a central bore 104 and formed with patterned electrodes on both sides, imput-output terminals 106 to be connected to the external circuits, a permanent magnet 107, a lower casing 108 for receiving the ceramic substrate 105, etc. and an upper casig 109 fixedly supporting the permanent magnet 107. The garnet plate 101 is placed on the shield plate portion 103, and the central conductors 102 are folded to wrap the garnet plate 101 using insulators (not shown), to isolate conductors 102 from one another, to form a central conductor means 110 as shown in FIG. 2. With continued reference to FIG. 1, the ceramic substrate 105 has on an upper side three land portions 111*a*, 111*b* and 111*c* to which the terminal portions of the central conductors 102 are connected, a land portion 111*d* for grounding, and a terminal resistor 112 between the land portions 111*c* and 111*d*. The lower side of the ceramic substrate 105 is formed with a ground terminal over substantially the entire substrate area, and the ground terminal on the lower side is connected to the ground land portion 111*d* on the upper surface through a hole (not shown). The terminal resistor 112 of this ceramic substrate 105 is formed by a ruthenium oxide coating film so that resistance between the land portions 111*c* and 111*d* is 50 Ω.

Figure 3:
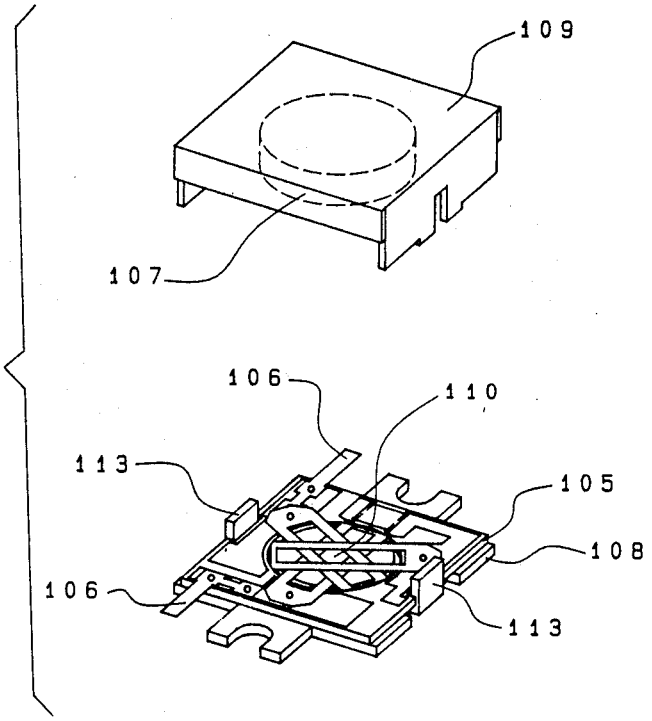
FIG. 3 is an exploded view of the isolator of FIG. 1.
Figure 4:
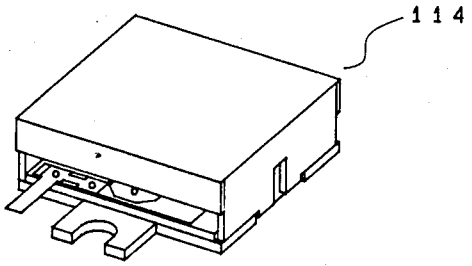
FIG. 4 is a perspective view of the assembled isolator of FIG. 1.

As shown in FIG. 3, in the isolator of FIG. 1 the ceramic substrate 105 is fixedly received in the lower casing 108 with the input-output terminals 106 connected to the ceramic substrate 105. Received in the central bore 104 of the ceramic substrate 105 is the central conductor means 110 with its terminals, which are tip ends of the central conductors 102, connected to the land portions 111*a*, 111*b* and 111*c* of the ceramic substrate 105. The upper casing 109 fixedly supporting the permanentmagnet 107 is assembled to the lower casing 108 with projections 113 of the lower casing 109 inserted into notches of the upper casing 109, thereby providing the isolator 114 as shown in FIG. 4. This isolator 114 is typically 20 mm×20 mm in both lateral sides and 5 mm in height.

Figure 5:
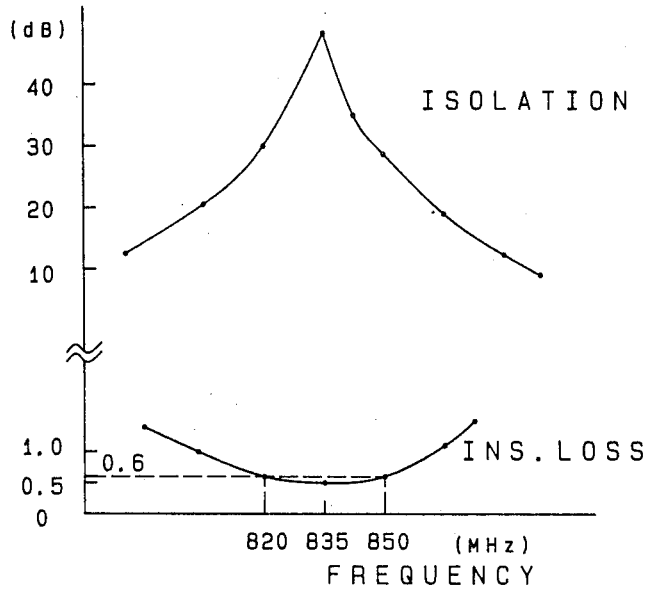
FIG. 5 is a graph showing the relation between insertion loss and frequency of the isolator according to one embodiment of the present invention.
Figure 7:
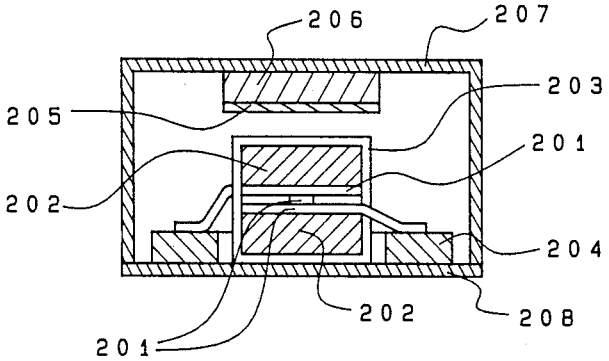
FIG. 7 PRIOR ART
FIG. 7 is a schematic cross-sectional view of a conventional isolator.

FIG. 5 graphically shows the insertion loss characteristics for this isolator 114. It is evident from this graph that the isolator of this invention is sufficiently satisfactory and utilizable as an isolator for frequency bands between 820–850 MHz.

Figure 6:
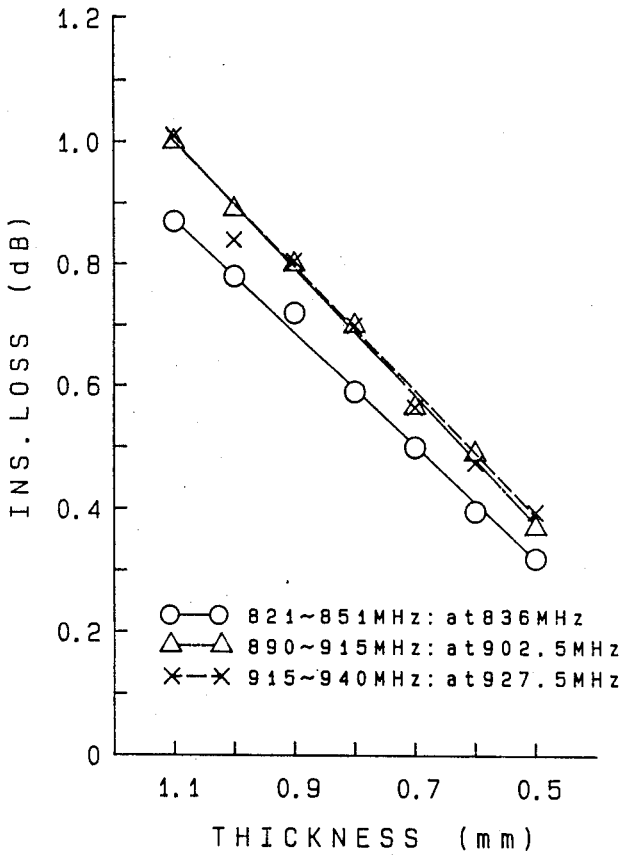
FIG. 6 is a graph showing the relation between insertion loss and thickness of garnet plate in the isolator according to one embodiment of the present invention.

Next, isolators having th same structure as above with the thickness of the garnet plate 101 varied were measured with respect to insertion loss for frequency bands of 821–851 MHz, 890–915 MHz and 915–940 MHz. The results are shown in FIG. 6. As is verified from the graph, the insertion loss becomes low as the thickness of the garnet plate decreases, and that the isolator of the present invention having a garnet thickness of 0.6 mm or less has an insertion loss of about 0.5 dB or less, which is sufficiently low for practical use.

It will be understood from the above that the isolator according to the present invention is a satisfactory lumped constant isolator having a thickness less than ½ of conventional isolators yet retaining good insertion loss characteristics. Further, since it has only one garnet plate, its production cost can be significantly reduced.

The present invention has been described referring to the attached drawings, but it should be noted that any modifications may be made unless they deviate from the scope of the present invention defined in the claims attached hereto.

What is claimed is:

1. A lumped constant non-reciprocal circuit element comprising a set of mutually insulated central conductors, only a single garnet plate not more than 0.6 mm in thickness, a ceramic substrate having a central bore and a planar surface with patterned electrodes formed thereon, said set of mutually insulated central conductors being positioned within said central bore, and a permanent magnet positioned proximate said garnet plate for applying a DC magnetic field to said garnet plate, wherein each of said mutually insulated central conductors is folded to wrappingly enclose said garnet plate when received in the central bore of said ceramic substrate, and wherein said substrate is further provided with a plurality of terminals connected to said patterned electrodes to which terminal portions of the central conductor are operatively connected.

2. The lumped constant non-reciprocal circuit element according to claim 1, wherein said circuit element is a circulator.

3. The lumped constant non-reciprocal circuit element according to claim 1, further including a resistor element operatively connected to one of said central conductors, wherein said circuit element is an isolator.

* * * * *